United States Patent [19]

Grohoski

[11] 4,252,009

[45] Feb. 24, 1981

[54] RE-ROLLING ATTACHMENT FOR THREAD ROLLING MACHINE

[75] Inventor: Edward G. Grohoski, Litchfield, Conn.

[73] Assignee: Hartford Special, Inc., Hartford, Conn.

[21] Appl. No.: 22,311

[22] Filed: Mar. 20, 1979

[51] Int. Cl.[3] ..... B21H 3/06

[52] U.S. Cl. ..... 72/90

[58] Field of Search ..... 72/88, 90

[56] References Cited

U.S. PATENT DOCUMENTS

| | | | |
|---|---|---|---|
| 2,967,444 | 1/1961 | Hallberg et al. | 72/90 |
| 3,842,633 | 10/1974 | Morton et al. | 72/90 |
| 3,879,976 | 4/1975 | Morton | 72/90 |

*Primary Examiner*—Milton S. Mehr

*Attorney, Agent, or Firm*—Hayes & Reinsmith

[57] ABSTRACT

A significantly simplified, rugged attachment is provided for a standard thread rolling machine for quick and easy re-rolling of threaded parts for producing high quality threads. A pressure foot is mounted between an open end of a feed chute and the starting end of a fixed die and is biased toward a confronting movable die for urging a threaded part into mesh with the die surface of the movable die when it is moving toward a rear limit position. Such mesh between the threaded part and movable die is effected before the threaded part is pushed by a starter blade into matched rolling position against a starting end of the fixed die and thereafter the moving die reverses its direction of movement to stroke into a forward limit position to effect precision re-rolling of the previously threaded part to produce a high quality finished part.

9 Claims, 4 Drawing Figures

RE-ROLLING ATTACHMENT FOR THREAD ROLLING MACHINE

This invention generally relates to thread rollers and specifically concerns a re-rolling attachment for a thread roller of a type generally described in U.S. Pat. No. 3,879,976 entitled "Starter Slide and Blade Assembly for Thread Roller" issued Apr. 29, 1975 in the name of Robert D. Morton and assigned to the assignee of this invention.

A principal object of this invention is to provide new and improved re-rolling attachment for a thread roller and which features a resilient pressure foot mechanism specifically designed to positively mesh a threaded shank with a moving die before insertion into a rolling position in match with a fixed die.

Another object of this invention is to provide new and improved re-rolling attachment of the type described which is quick and easy to install on either new or existing machines to effect a threading operation a second time to burnish threads in a fastener of superior quality.

A further object of this invention is to provide such a re-rolling attachment which is economical and comprises a minimum number of different parts to repetitively and reliably transfer a workpiece into matched rolling positions between dies.

Other objects will be in part obvious and in part pointed out more in detail hereinafter.

A better understanding of the objects, advantages, features, properties and relationships of this invention will be obtained from the following detailed description and accompanying drawings which set forth an illustrative embodiment and is indicative of a way in which the principle of this invention is employed.

Figure 1:
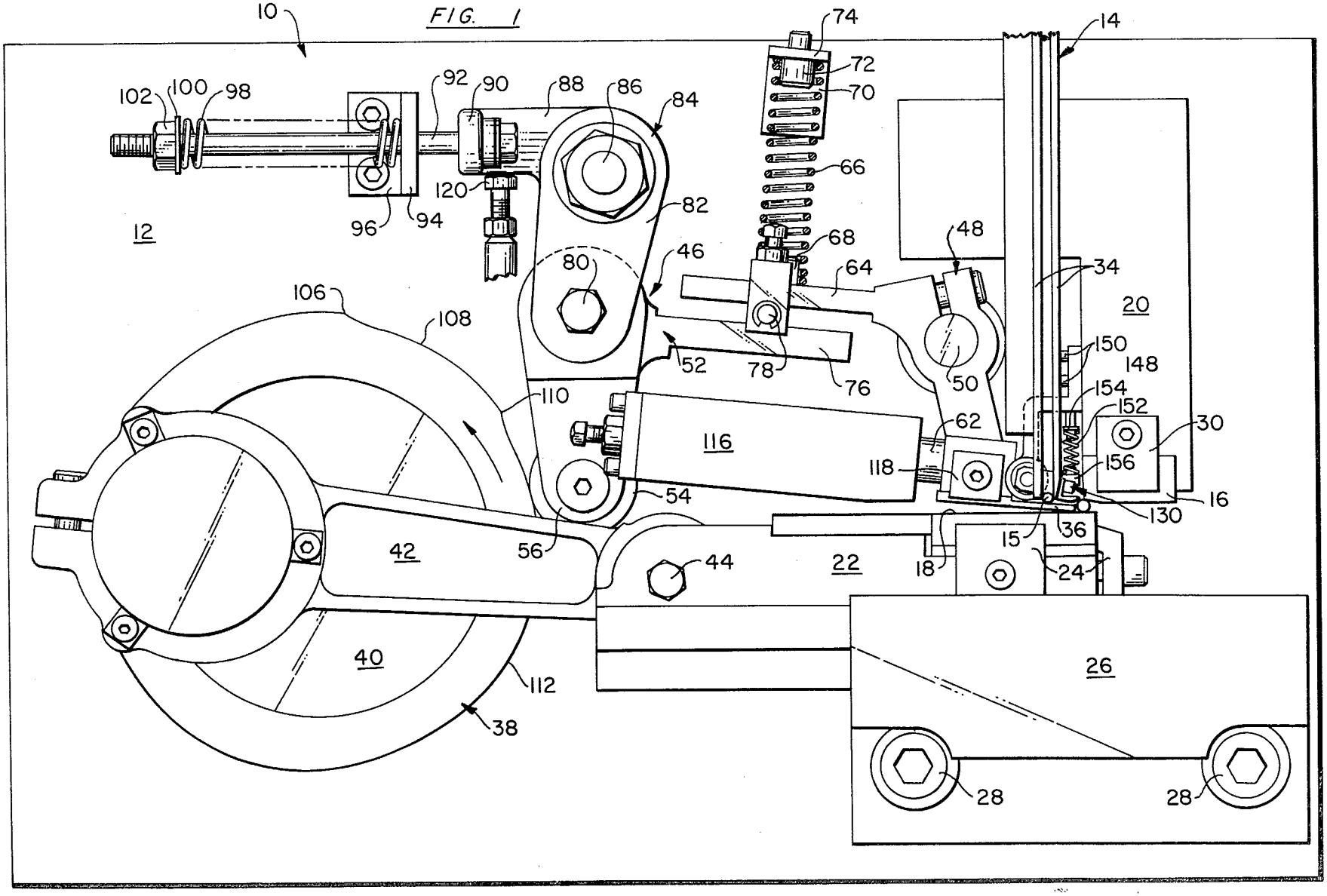
FIG. 1 is a partial plan view of a thread rolling machine showing a re-rolling attachment incorporating this ivention.

Referring to the drawings in detail, a thread rolling machine 10 is illustrated in FIG. 1. The machine 10 includes an elongated frame on table 12 to which is mounted a feed chute or guide track 14 for conveying threaded parts such as fasteners in line from a hopper, now shown, to a pair of cooperating stationary and reciprocable dies 16 and 18 respectively. The stationary die 16 is mounted on a stationary die block 20, and the movable or reciprocable die 18 is mounted to a slide 22 by an adjustable clamp assembly 24.

Slide 22 is supported for reciprocable movement on a slide block 26 which can be adjusted on table 12 by suitable fasteners 28 for insuring alignment of the spacing between the stationary and reciprocable dies 16 and 18. A suitable clamp assembly 30 is provided for holding stationary die in place on die block 20.

Guide track 14 will be understood to be downwardly inclined so that threaded parts such as the one shown at 15 are fed between rails 34 of track 14. A combination gate and starter blade 36 is mounted adjacent an open end of track 14 for reciprocable movement between stationary and reciprocable dies 16 and 18. Blade 36 is driven for successively feeding each end fastener such as that shown at 15 from track 14 to a start position between the starting ends of dies 16, 18. The feeding of each part 15 is initiated and timed to cooperate with reciprocable movement of slide 22 by a cam 38 driven by a main crank, not shown, of the machine 10.

To reciprocate slide 22 and therefore the driven reciprocable die 18, crank wheel 40 has one end of a pitman arm 42 eccentrically pivotally mounted on crank wheel 40, and the other end of pitman arm 42 is pivotally connected to slide 22 by pivot pin 44. For each revolution of crank wheel 40, reciprocable die 18 is driven through one complete cycle with the stroke of die 18 being dependent upon the eccentricity of the pivotal mounting of pitman arm 42 to crank wheel 40.

To pace operation of starter blade 36, a drive mechanism 46 is provided which serves to retract starter blade 36 in one linear direction to open the end of track 14 and to remain open long enough for a single threaded part 15 to be admitted from the end of track 14 into position between the starting end of each die 16, 18. Drive mechanism 46 includes a one-way drive lever or operating lever 48, supported on a fixed pivot pin 50 secured to table 12, for movement in a plane parallel to the table 12, and a cam follower or cam roll lever 52 having a cam roll 54 shown mounted on a free end of lever arm 56 of the cam roll lever 52. The operating lever 48 likewise has a driving connection to a slide bar 62 on which starter blade 36 is mounted. Operating lever 48 includes an angularly offset adjustment arm 64 which is biased in a counterclockwise direction as viewed in FIG. 1 by a drive return spring 66. Drive return spring 66 has one end seated against arm 64 in surrounding relation to a head of a plunger 68 fixed to operating lever arm 64. An opposite end of spring 66 is seated on an L-shaped bracket 70 suitably fixed to table 12 and retained in position by a plunger 72 received within the confines of spring 66 with plunger 72 fixed to an upstanding ear 74 of bracket 70.

Extending generally parallel to the operating lever adjustment arm 64 is an adjustment arm 76 of cam roll lever 52 which is spaced from the operating lever adjustment arm 64 in operative relation thereto by a roller 78 establishing a pivot point connection between the operating lever 48 and the cam roll lever 52. The latter is shown having its lever arm 56 extending in generally perpendicular relation to its adjustment arm 76.

During normal operation, cam roll lever 52 is supported for pivotal movement about a pivot pin 80 to which an arm 82 of a starter engage lever 84 is secured. Starter engine lever 84 in turn is supported for pivotal movement about a fixed pivot pin 86 mounted to table 12 whereby both starter engage lever 84 and interconnected cam roll lever 52 are supported for selective movement in parallel overlying relation to table 12.

Starter engage lever 84 has a second arm 88 with an upstanding ear 90 which will be understood to have an oversized opening, not shown, through which a bolt 92 extends. A similarly enlarged opening, not shown, is formed in an upstanding ear 94 of a bracket 96 fixed to table 12. Bolt 92 extends through ear 94 which serves as a stop for one end of a spring 98 having its other end seated against a washer 100 adjustably fixed in position on a threaded end portion of bolt 92 against an adjustment nut 102. Spring 98 accordingly will retain starter engage lever 84 in a selected position within the limits of the enlarged openings through which bolt 92 extends, to establish pivot pin 80 as a normally fixed pivot point for cam roll lever 52 for an operating cycle of machine 10 with cam roll 54 in engagement with the contoured profile of driving cam 38 on the outer periphery of crank wheel 40.

Figure 4:
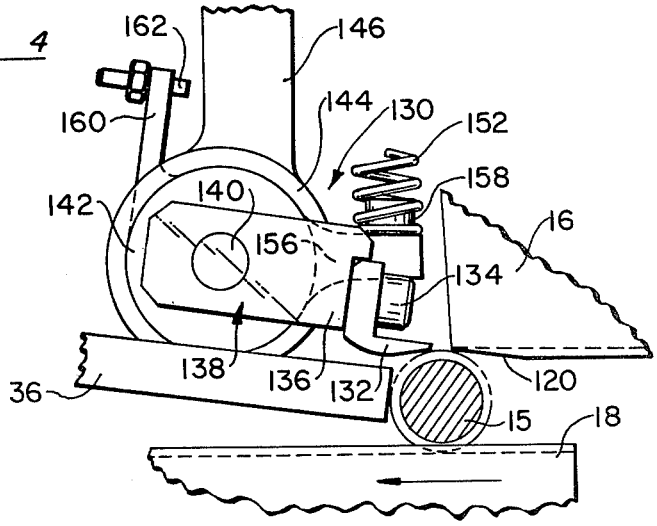
FIG. 4 is an enlarged plan view similar to that of FIG. 2 wherein the re-rolling attachment is shown with the starter blade in full return position.

While generally circular, the outer peripheral feed control contour of cam 38 has a high point or position of maximum radius 106 which forces cam roll lever 52 counterclockwise about its pivot pin 80 to drive operating lever 48 clockwise about its pivot pin 50 and against the bias of drive return spring 66. This action opens the discharge end of feed rails 34 of track 14 in timed relation to movement of reciprocable die 18 away from stationary die 16 by retracting starter blade 36 into full open position (FIG. 2) in one linear direction to the left of its illustrated starting position (FIGS. 1 and 4). Such action is effected by operating lever 48 which is in one-way driving engagement with slide bar 62 in one angular direction (clockwise) of movement of operating lever 48 to permit discharge of an end fastener from rails 34.

Subsequent to such fastener discharge, cam roll 54 passes high point 106 of cam 38 to permit drive return spring 66 to move operating lever arm 64 in a counterclockwise direction and cam roll lever 52 in a clockwise direction to continuously maintain cam roll 54 in constant engagement with driving cam 38.

Figure 2:
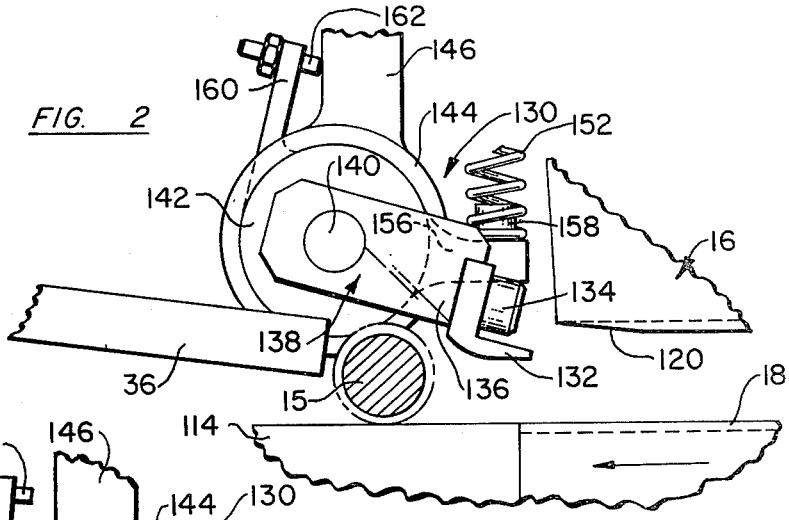
FIG. 2 is a plan view, partly broken away and partly in section, showing component parts of the re-rolling attachment on an enlarged scale in a full open starter blade position and wherein certain parts are omitted for clarity of illustration.
Figure 3:
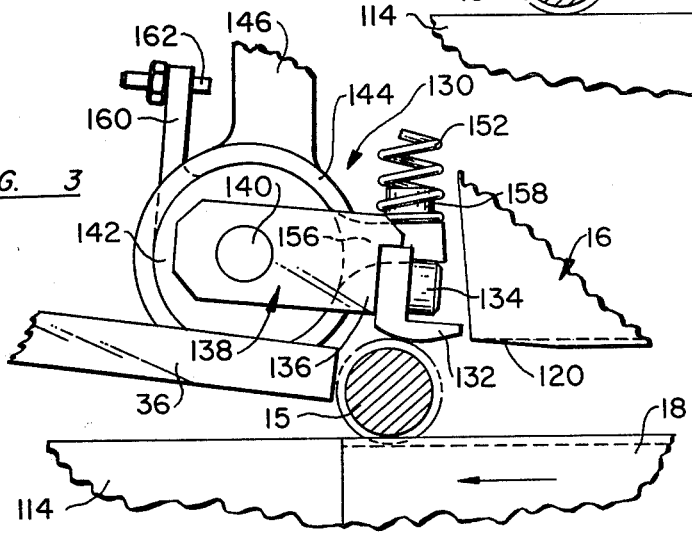
FIG. 3 is an enlarged plan view similar to that of FIG. 2 wherein the re-rolling attachment is shown with the starter blade in partial return position.

More specifically and in accordance with this invention, the cam cycle from a maximum radius cam surface terminates at the high point or position of maximum radius 106 and cam surface 108 provides a partial return from maximum to minimum cam radius upon cam roll 54 riding over high point 106, whereupon drive mechanism 46 engages cam control surface 108 and moves starter blade 36 into partial return position (FIG. 3). Cam surface 108 accordingly provides a dwell for drive mechanism 46 for a predetermined time and thereafter upon cam roll 54 riding over point 110 and onto minimum radius cam surface 112, drive mechanism 46 drives starter blade 36 into starting position (FIGS. 1 and 4) in timed relation to return movement of slide 22 just before it reverses direction at its back dead center position. As slide 22 reverses direction to drive die 18 toward its forward stroke limit position, blade 36 dwells in starting position before moving to full open position (FIG. 2) as cam roll 54 continuously follows along the cam surface which gradually increases from minimum radius (112) to maximum radius circumferentially extending along cam 38 and terminating at point 106. Such dwell and starter blade movement back to full open position is in timed relation to movement of slide 22 as it again reverses direction and returns rearwardly toward back dead center position whereupon the next threaded part 15 slides from rail 34 into position against a wear plate 114 on the slide 22 as die 18 approaches its back stroke limit position.

In the specifically illustrated embodiment, slide bar 62 is mounted within a housing 116 bolted to table 12 for reciprocable movement toward and away from the work station between dies 16, 18. More specifically, slide bar 62 has an exposed working end protruding from housing 116 and a keeper clamp 118 is releasably secured to fix blade 36 in position on slide bar 62. Blade 36 is in a plane generally perpendicular to the discharge end of feed rails 34 when movement of blade 36 is terminated in a feeding direction at its illustrated starting position. Additionally, blade 36 is of such a length that it extends between opposed surfaces of dies 16, 18 a sufficient amount to insure proper starting of each threaded part between the dies 16, 18 upon termination of the starter blade stroke in a feeding direction to push the threaded part across into the throat between moving die 18 and onto roll-on portion 120 of stationary die 16.

It is to be understood that slide bar 62 is adjustably mounted within housing 108 to provide a selected biasing force urging slide bar 62 and its starter blade 36 in a threaded part feeding direction while slide bar 62 and blade 36 are continuously maintained in a desired aligned position to repetitively establish the same desired starting position of blade 36, as determined by cam 38, between the stationary and reciprocable dies 16, 18 without any danger of driving blade 36 into the moving die path.

Starter assembly inertia can be reduced by virtue of the disclosed arrangement wherein the stroke length of the blade 36 may be varied simply by selectively changing the pivot point connection between adjustment arms 64 and 76 of drive levers 48 and 52 as specifically disclosed in the above-referenced U.S. Pat. No. 3,879,976, the subject matter of which is incorporated herein by reference. As described, the terminal position of the starter blade 36 in a part feeding direction is established by a cam roll, not shown, mounted on operating lever 48 and which serves as a positive stop for blade 36 in such part feeding direction.

Particular types of threaded parts such as certain high quality screws, e.g., subject to demanding quality control requirements with little or no allowance for poorly-formed threads are normally passed through a roll threading operation a second time to achieve the desired high quality thread on the shank of the part. The second threading operation removes nicks or burrs caused by handling a previously threaded part through operations such as heat treating, cross drilling and other manufacturing operations subsequent to the initial thread rolling. Such re-rolling effectively burnishes the threads with little metal deformation taking place.

To effect re-rolling in a significantly simplified construction which has been found to successfully produce high strength, superior quality fasteners, a rugged and compact re-rolling attachment 130 is installed in machine 10 and is particularly designed such that it does not hinder standard initial rolling of threads whatsoever on blank shanks. As best seen in FIGS. 2–4, a pressure foot 132 is secured by fastener 134 to a swinging end 136 of arm 138 fixed adjacent its opposite end to a pin 140 supported for oscillating movement on a suitable journal 142 mounted in bearing 144. Bearing 144 is integrally formed on a terminal portion of leg 146 which is in offset fixed relation to bracket 148 secured by fasteners 150 to stationary die block 20.

To continuously urge pressure foot 132 in a clockwise direction as viewed in the drawings to bias part 15 toward engagement with the movable die 18, a spring 152 is provided having opposite ends seated against a fastener 154, mounted on bracket 148, and against a radial arm 156 projecting from journal 142 in underlying relation to bearing 144. Fastener 154 will be understood to be adjustably mounted on bracket 148 in alignment with a projection 158 on arm 156 about which spring 152 is coiled to selectively establish a desired spring force on pressure foot 132. An angularly offset arm 160 extends from journal 142 below bearing 144 and carries an adjustable stop 162 engageable with leg 146 to terminate pivotal movement of pressure foot 132 in a clockwise direction (FIG. 2 only). Pressure foot 132 and starter blade 36 are preferably located above the plane of the pressure foot bearing journal 142 with the pressure foot 132 underlying the rails 34 in downstream relation to the open throat of the stationary track end but upstream of the stationary die 16 adjacent its roll-on portion 120.

By virtue of the above-described construction, thread re-rolling attachment 130 positively matches a threaded shank part 15 with the die surface of movable die 18 before being inserted by starter blade 36 into matched rolling position on stationary die 16. In matched rolling position, crests of threaded part 15 are aligned with valleys on both the movable die 18 and on the roll-on surface 120 of stationary die 16. Upon the common drive means, namely, crank wheel 40 being revolved in the direction of the arrow shown in FIG. 1, movable die 18 is driven rearwardly from its forward stroke limit position toward its rear limit position, as determined by the throw of pitman arm 42, whereupon rotary cam 38 and drive mechanism 46 effect return of starter blade 36 from its full open position (FIG. 2) upon cam follower 54 riding over high point 106 on cam 38. Such action moves starter blade 36 into partial return position (FIG. 3) as cam follower 54 rides along cam surface 108. Accordingly, the cam and drive mechanism cooperate to cause starter blade 36 to dwell in its partial return position wherein threaded part 15 is engaged by both the resiliently biased starter blade 36 and pressure foot 132 to be pressed into engagement with the rearwardly moving die 18 to cause matching of the threads of part 15 with those of die 18.

As cam roll 54 rides over point 110 of cam 38 into contact with its minimum radius surface 112, starter blade 36 is driven further to the right (as viewed in FIG. 3) into its starting position (FIG. 4) immediately or just before movable die 18 reverses direction at its back stroke limit position as determined by the back dead center position of pitman arm 42. Accordingly, part 15 is positively engaged in matched rolling position between moving die 18 and roll-on surface 120 of stationary die 16 and is resiliently retained therein jointly by starter blade 36 and pressure foot 132 just before slide 22 and movable die 18 reverse direction to move toward the forward stroke limit position.

Upon such movement of die 18 toward its forward stroke limit position (to the right as viewed in FIG. 1), the threaded shank of part 15 has accordingly been previously precisely seated in registry with the threads of both dies 16, 18 thereby to be re-rolled to burnish the threads of part 15 between dies 16, 18. During re-rolling upon forward stroking of die 18 and prior to full return of slide 22 to its back dead center position, starter blade 36 automatically dwells and thereafter retracts from its starting position (FIG. 4) as described above when cam roll 54 moves from minimum radius cam surface 112 toward its maximum cam radius establishing the full open position (FIG. 2) of starter blade 36 to gate the next part 15 for the succeeding re-rolling operation in a continuous cycling of the machine 10.

The disclosed thread re-rolling attachment 130 of this invention has been found to be particularly useful in providing high strength, superior quality fasteners, e.g., which are in increased demand for quality consumer products and in automatic assembly procedures requiring increased reliability. Moreover, no requirement is made for additional expensive complicated transfer components, rather, the simplified re-rolling attachment of this invention is quickly installed in new or existing thread rolling machine for reliable service over an extended working life and makes such machines more flexible in that the attachment does not hinder standard thread rolling operations on unthreaded fasteners.

As will be apparent to persons skilled in the art, various modifications, adaptations and variations of the fore-going specific disclosure can be made without departing from the teaching of the present invention.

I claim:

1. In a thread rolling machine wherein threaded parts are fed from a feed chute to a work station between starting ends of fixed and movable thread rolling dies mounted on a frame supporting a starter blade for reciprocable movement between a full open position gating the feed chute and a starting position for transferring and wedging in a threaded part between the starting ends of the dies, the fixed die having a starting end defining an inclined roll-on surface merging with a downstream fixed die surface, the starting end of the fixed die being spaced from the movable die at a distance relatively greater therefrom than the downstream fixed die surface, a thread re-rolling attachment comprising a pressure foot supported for movement on the frame at the work station, and biasing means cooperating with the pressure foot and urging it toward the movable die for engaging a threaded part transferred to the work station by the starter blade and positively meshing that part with the movable die prior to the part being wedged by the starter blade in thread seating engagement between the roll-on surface of the fixed die and the starting end of the movable die.

2. The thread re-rolling attachment of claim 1 wherein the biasing means includes a spring acting directly on the pressure foot, and adjustable mounting means between the spring and the frame for establishing a preselected spring force urging the pressure foot toward the movable die.

3. The thread re-rolling attachment of claim 4 wherein the pressure foot is supported on the frame for pivotal movement in the work station, wherein adjustable stop means is provided for establishing an operative position of the pressure foot in the work station by limiting movement of the pressure foot in a first angular direction under the force of the spring, and wherein the pressure foot is driven in an opposite angular direction against the biasing force of the spring upon starter blade insertion of a threaded part between the pressure foot and movable die.

4. The thread re-rolling attachment of claim 1 wherein the pressure foot includes a swinging projecting end movable along an arcuate path of movement between the end of the feed rail and starting end of the fixed die for engaging a threaded part to be re-rolled and resiliently biasing it into thread meshing engagement with the movable die.

5. In a thread rolling machine wherein threaded parts are fed from a feed chute to a work station between starting ends of fixed and movable thread rolling dies mounted on a frame supporting a starter blade for reciprocable movement between a full open position gating the feed chute and a starting position for transferring and wedging a threaded part between the starting ends of the dies, a thread re-rolling attachment comprising common drive means mounted on the frame for reciprocating the movable die between back and forward stroke limit positions relative to the fixed die and for reciprocating the starter blade in timed relation to movement of the movable die, a rotary cam and drive mechanism connected between the common drive means and the starter blade for returning it from its full open position to its starting position during rearward movement of the movable die toward its back stroke limit position, the cam and drive mechanism cooperating to cause a dwell of the starter blade in a partial return position intermediate its full open and starting positions, a pressure foot supported for movement on the frame at the work station, and biasing means cooperating with the pressure foot and urging it toward the movable die for engaging a threaded part transferred to the work station by the starter blade, the starter blade and pressure foot being engageable with the threaded part in the partial return position of the starter blade whereby the pressure foot biasing means causes meshing of the threads of the threaded part and the rearwardly moving die before it reverses direction at its back stroke limit position.

6. The thread re-rolling attachment of claim 4 wherein the cam and drive mechanism cooperate to drive the starter blade from its partial return position into starting position immediately before the rearwardly moving die reverses direction at its back stroke limit position for urging the threaded part into matched rolling position between the dies prior to forward stroking of the movable die.

7. In a thread rolling machine wherein threaded parts are fed from a feed chute to a work station between starting ends of fixed and movable thread rolling dies mounted on a frame supporting a starter blade for reciprocable movement between a full open position gating the feed chute and a starting position for transferring and wedging a threaded part between the starting ends of the dies, a thread re-rolling attachment comprising drive means mounted on the frame for reciprocating the movable die between back and forward stroke limit positions, a cam controlled drive mechanism mounted on the frame for moving the starter blade from its full open position to its starting position in timed relation to rearward movement of the movable die toward its back stroke limit position such that the threaded part is in a matched rolling position between the fixed and movable dies immediately before the movable die reverses direction to move toward its forward stroke limit position, a pressure foot supported for movement on the frame at the work station, and biasing means cooperating with the pressure foot and urging it toward the movable die for engaging a threaded part transferred to the work station by the starter blade and positively meshing that part with the movable die before being inserted into said matched rolling position.

8. The thread re-rolling attachment of claim 7 wherein the starter blade drive mechanism moves the starter blade from starting position to full open position during return of the movable die toward its back limit position to automatically condition the machine for its next re-rolling cycle.

9. The thread re-rolling attachment of claim 7 wherein the starter blade in its starting position and the pressure foot jointly coact to maintain the threaded part in matched rolling position while the movable die reverses movement at its back stroke limit position.

* * * * *

UNITED STATES PATENT AND TRADEMARK OFFICE

CERTIFICATE OF CORRECTION

PATENT NO. : 4,252,009

DATED : February 24, 1981

INVENTOR(S) : Edward G. Grohoski

It is certified that error appears in the above—identified patent and that said Letters Patent is hereby corrected as shown below:

Column 1, line 28, wherein the word "positions" should be --position--;

Column 2, line 57, wherein the word "engine" should be --engage--;

Column 6, line 21, wherein the word "in a threaded" should be --a threaded--;

Column 6, line 43, wherein the number "4" should be --2--;

Column 7, line 24, wherein the number "4" should be --5--.

Signed and Sealed this

Thirtieth Day of June 1981

[SEAL]

Attest:

RENE D. TEGTMEYER

Attesting Officer

Acting Commissioner of Patents and Trademarks